US006213298B1

(12) United States Patent
Nguyen

(10) Patent No.: US 6,213,298 B1
(45) Date of Patent: Apr. 10, 2001

(54) SHOE BOX WITH INTERNAL DISPLAY AND FLIP TAG

(75) Inventor: Chau M. Nguyen, Boca Raton, FL (US)

(73) Assignee: BBC International, Ltd., Boca Raton, FL (US)

( * ) Notice: Subject to any disclaimer, the term of this patent is extended or adjusted under 35 U.S.C. 154(b) by 0 days.

(21) Appl. No.: 09/390,610

(22) Filed: Sep. 3, 1999

(51) Int. Cl.[7] ..... B65D 85/00

(52) U.S. Cl. ..... 206/459.1; 206/459.5; 206/767; 229/172

(58) Field of Search ..... 206/459.1, 459.5, 206/767, 768, 736, 278, 299, 457, 45.29, 45.3; 40/312; 229/165, 172, 146, 147

(56) References Cited

U.S. PATENT DOCUMENTS

| | | | | |
|---|---|---|---|---|
| 370,540 | * | 9/1887 | Hodge | 40/312 |
| 534,799 | * | 2/1895 | Koehler | 40/312 |
| 1,363,298 | * | 12/1920 | Yeomans | 260/768 |
| 1,860,309 | | 5/1932 | Davidson . | |
| 2,022,721 | | 12/1935 | Hompe . | |
| 2,102,077 | * | 12/1937 | Kahn | 40/312 |
| 2,136,797 | * | 11/1938 | Lee | 206/768 |
| 2,168,240 | * | 8/1939 | Roberts | 206/45.29 |
| 2,217,504 | * | 10/1940 | Bergstein | 229/172 |
| 2,228,054 | | 1/1941 | Horwath . | |
| 2,439,959 | | 4/1948 | Anderson, Jr. . | |
| 2,702,663 | * | 2/1955 | Klein | 229/172 |
| 2,913,967 | * | 11/1959 | Scriven, Jr. | 229/172 |
| 2,928,580 | * | 3/1960 | Arneson | 229/172 |
| 2,942,726 | | 6/1960 | Marsh . | |
| 2,980,308 | * | 4/1961 | Bolding | 229/172 |
| 3,189,248 | * | 6/1965 | Roccaforte | 229/172 |
| 3,362,529 | * | 1/1968 | Gant et al. | 206/278 |
| 3,918,631 | | 11/1975 | Hackenburg . | |
| 4,765,535 | * | 8/1988 | Michetti | 229/172 |
| 4,828,164 | | 5/1989 | Passamoni . | |
| 4,905,831 | | 3/1990 | Bagdis et al. . | |
| 4,953,779 | | 9/1990 | Densen . | |
| 5,582,293 | | 12/1996 | Kay . | |
| 5,762,191 | * | 6/1998 | Etzion et al. | 206/278 |

* cited by examiner

*Primary Examiner*—Luan K. Bui
(74) *Attorney, Agent, or Firm*—Eric Bleich

(57) ABSTRACT

A shoe box is provided having a bottom, a front, a back and lateral sides, the box having an open top wherein the front and lateral sides have partial internal flaps folded over their top edges forming an internal border. The back side has an internal panel that is folded over, presenting a display with printed product information. The shoe box may separately or further be provided with a flip tag, i.e, a figurine having an outwardly facing display is secured to an internal surface of the front. The figurine can be folded downwardly and inwardly when in a stowed position and upwardly and outwardly when in a displayed position visible to a prospective purchaser.

1 Claim, 4 Drawing Sheets

10
32
28
16
30
22
12
22
18
18
26
26
24
24
20
20
27
24
14

FIG. 5
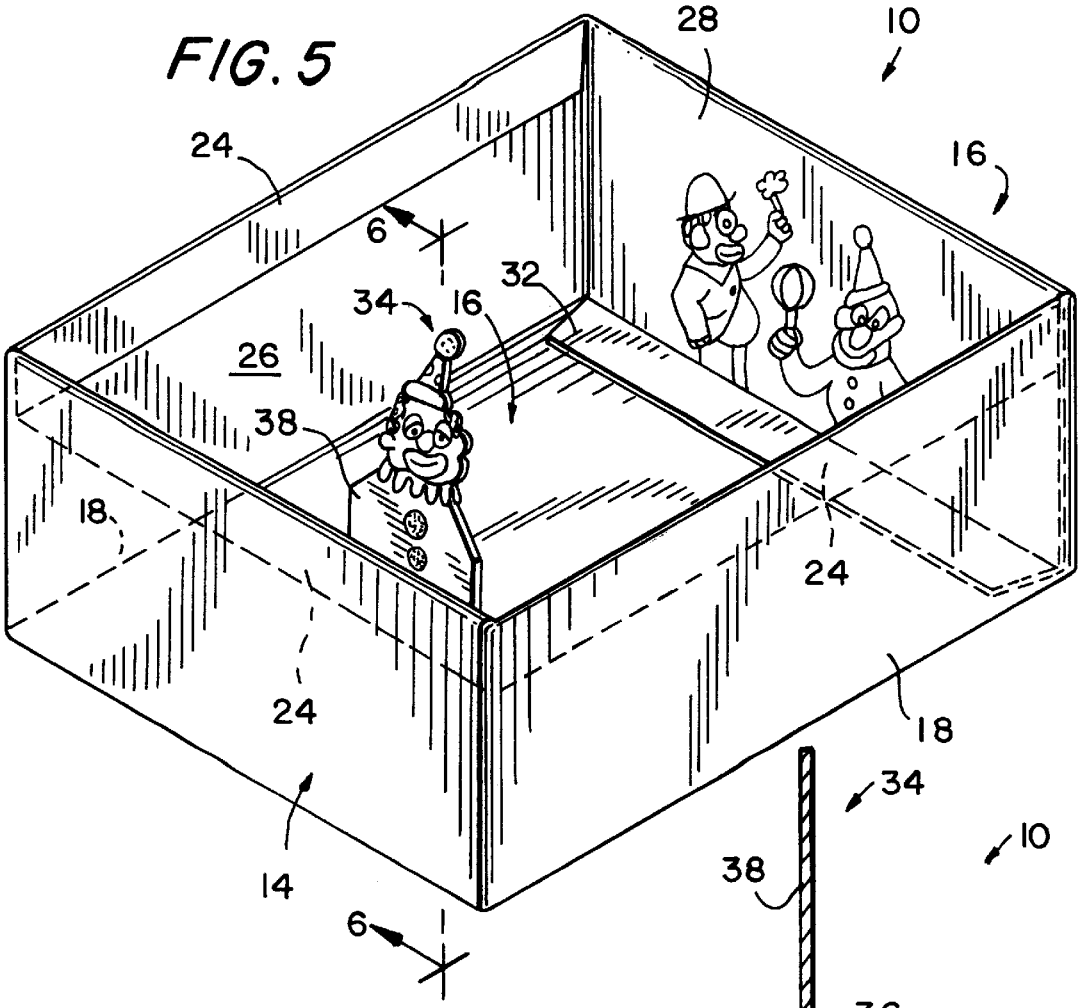
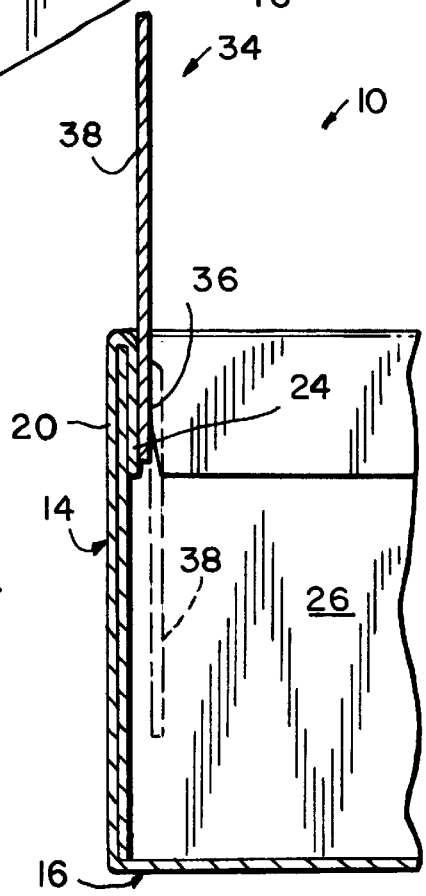
FIG. 6

SHOE BOX WITH INTERNAL DISPLAY AND FLIP TAG

TECHNICAL FIELD

The present invention relates to cartons for packaging footwear, particularly boxes that contain and display athletic shoes.

BACKGROUND

Footware can be designed to provide a variety of stylistic and functional benefits. In order to inform the prospective purchaser and draw attention to these features, it is desirable to effectively impart information about them at point of purchase.

U.S. Pat. No. 4,953,779 to Densen discloses a container having side walls that are formed from a panel having a central fold line and having the top portion folded over to form the interior of the side wall. The interior of the side walls, along with the interior of the bottom and end walls, have indicia.

U.S. Pat. No. 4,905,831 to Bagdis et al. discloses a magnetic disk package having instructions and other indicia written on the interior sides of the end walls.

U.S. Pat. No. 3,918,631 to Hackenberg discloses a container having side walls made from an outer wall and inner wall. The outer wall is removed by the end user. The inner walls have a decorative surface.

Others have attempted to incorporate tags in containers.

U.S. Pat. No. 1,860,309 to Davidson discloses a container that has a tag connected along a fold line to side wall. The panel is folded inside the box and covered by lid. After the container is opened, the panel is put in an upright position for display.

U.S. Pat. No. 2,002,721 to Hompe discloses a carton having a panel having advertising written on the interior. After the carton is opened, the panel is opened to display the advertising.

Therefore it is desirable to provide a blank carton specifically adapted for shoe packaging that incorporates a display for viewing when the shoe box is fully-constructed, while minimizing the amount of blank needed to form the remainder of the un-printed box.

It is further desirable to provide a shoe box with a decorative tag that can be activated when the box is open to enhance the attractiveness of the display and identify the product.

SUMMARY

According to the subject invention, a shoe box is provided having a bottom, a front, a back and lateral sides, the box having an open top wherein the front and lateral sides have partial internal flaps folded over their top edges forming an internal border. The back side has an internal panel that is folded over, presenting a display with printed product information.

According to another aspect of the invention, a shoe box is provided having a bottom, a front, a back and lateral sides, the box having an open top wherein the front has in internal surface on which a figurine with an outwardly facing display is secured, the figurine being folded downwardly and inwardly when in a stowed position and upwardly and outwardly when in a displayed position visible to a prospective purchaser.

An advantage of the present invention is that a shoe box is provided that avails itself of a strategic area of the internal product display surface that is most visible to a purchaser, while minimizing the need for internal printing and material usage for the remainder of the box.

Another advantage of the present invention is that a pop-up display tag is provided that identifies the product and attracts attention of a purchaser from a most visible location.

Other objects and advantages of the present invention will become apparent to those skilled in the art, by a careful examination of the following Specification, Claims and Drawings wherein reference numerals correspond to like descriptions in the Specification.

BRIEF DESCRIPTION OF THE DRAWINGS

FIG. 5 is a front perspective view of the shoe box of FIG. 4, with the flip tag shown in an "UP" position for outward display to a prospective purchaser; and FIG. 6 is a cross sectional view taken substantially along lines 6—6 of FIG. 5.

Those skilled in the art will more fully appreciate the above FIGS. 1–6 by a careful reading of the following Detailed Description of one or more preferred embodiments, to which the same pertain.

DETAILED DESCRIPTION

Figure 2:
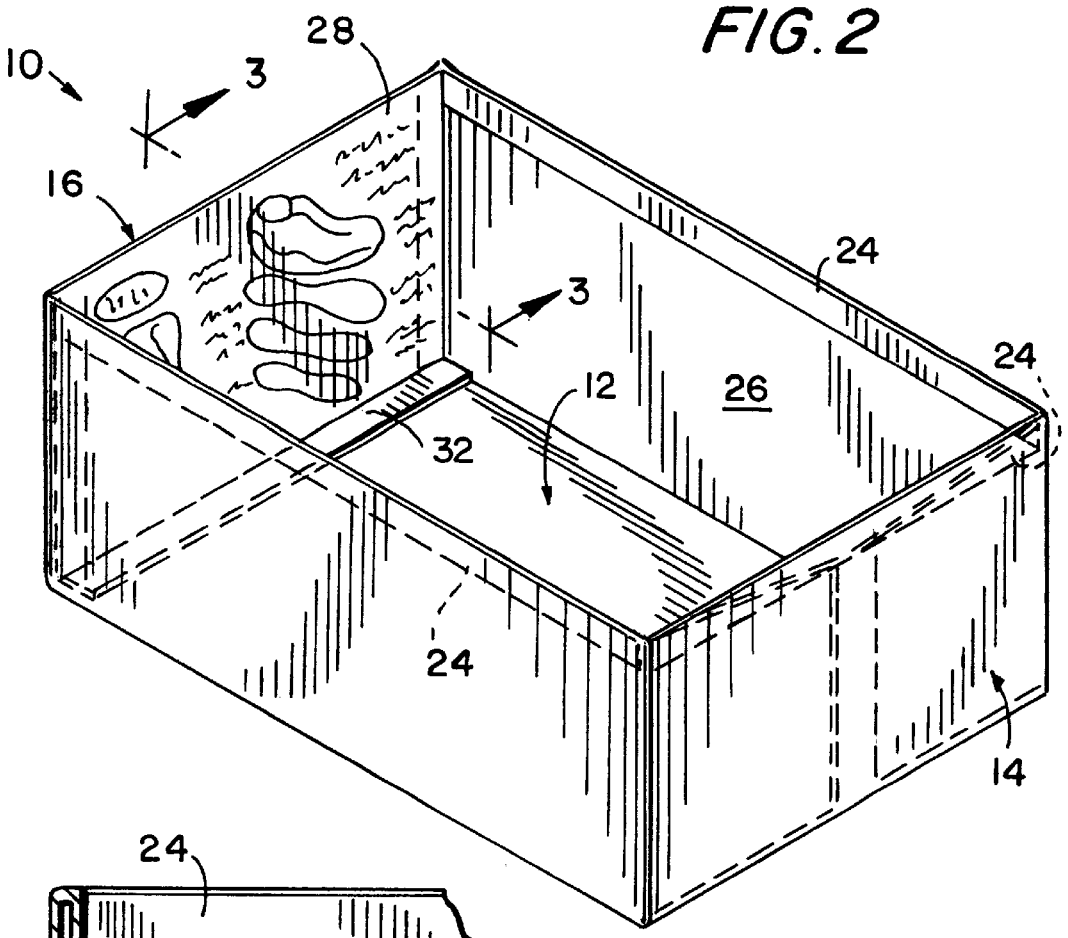
FIG. 2 is a front perspective view of a shoe box of the present invention, fully-constructed from the carton blank of FIG. 1, showing the internal rear panel having product indicia displayed for a prospective purchaser.
Figure 3:
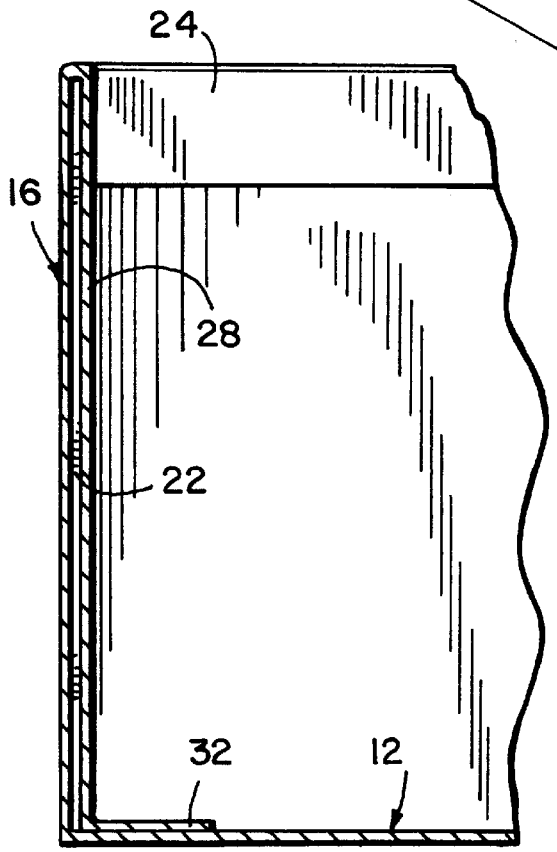
FIG. 3 is a cross section taken at lines 3—3 of FIG. 2, through the major folded over rear panel.
Figure 4:
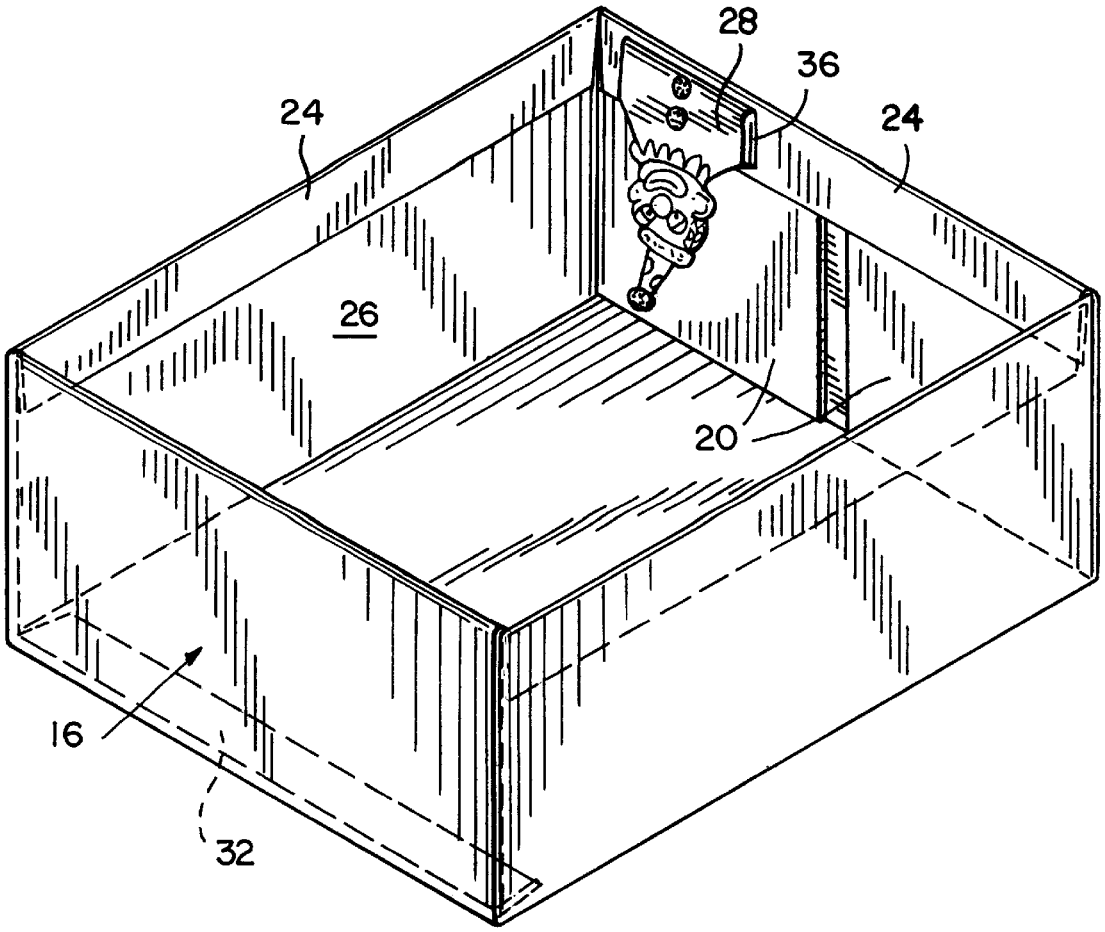
FIG. 4 is a rear perspective view of a shoe box with a flip tag of the present invention, shown in a "DOWN" position.

According to the present invention, a carton blank and shoe box fully-constructed therefrom are generally shown at 10, in FIGS. 1–6. More specifically and for purposes of illustration, FIG. 2 generally shows a display with product information and FIGS. 4–5 show a pop-up display figurine that emerges when the top (not shown) of the box 10 is removed. In each embodiment, the display is hidden during storage or shipping of the product, then visible to a prospective purchaser when the packaging is opened for retail display. Those skilled in the art will further appreciate that the present invention could take the form of packaging used for a sports shoe or other footwear.

Figure 1:
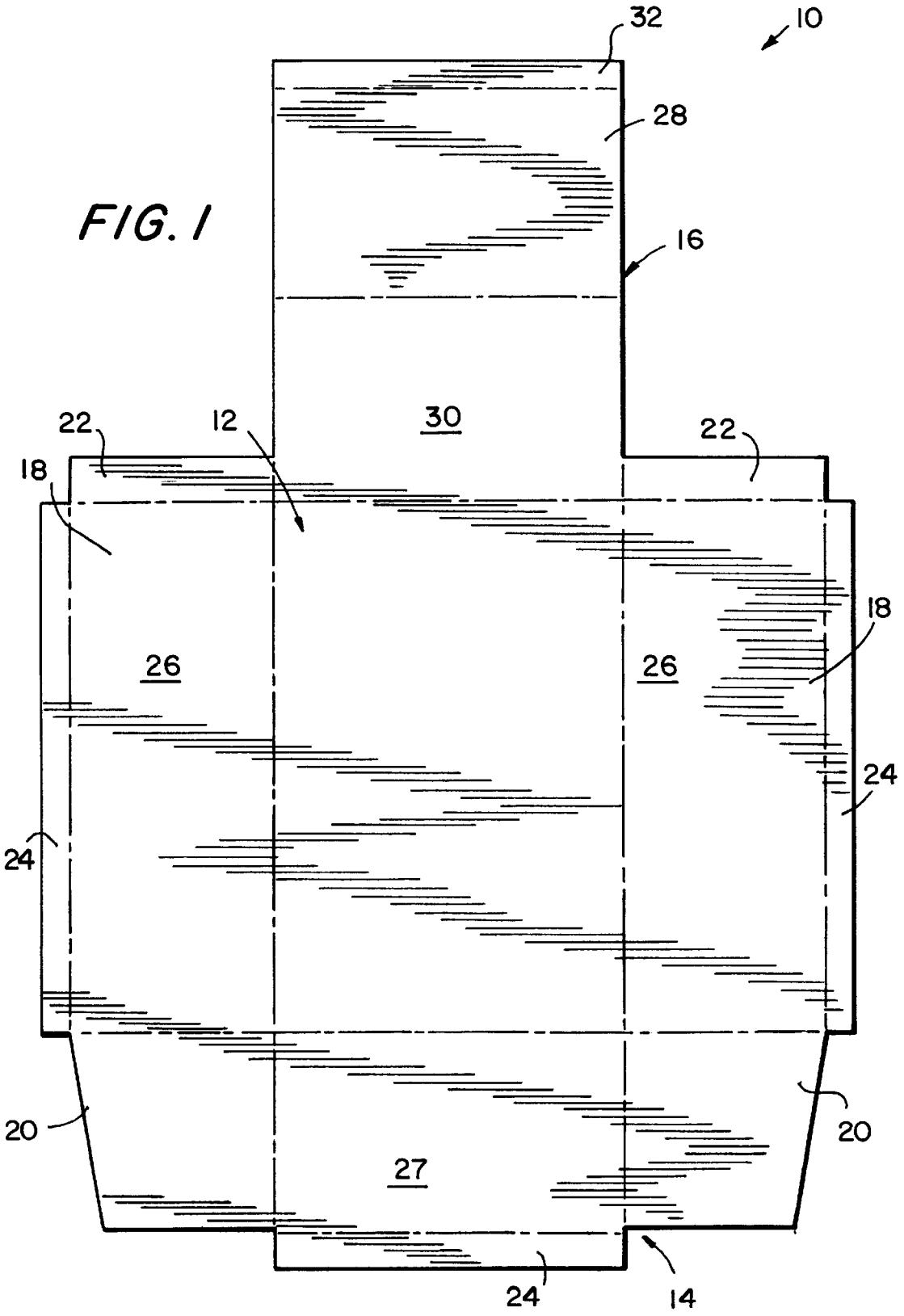
FIG. 1 is a top plan view of an opened blank used to form a shoe box of the present invention, shown prior to construction.

Further according to the subject invention, as shown in FIG. 1, blank 10 has a bottom 12, a front 14, a back 16 and lateral sides 18 formed from a unitary carton material. The sides 18 each have major 20 and minor 22 adhesion flaps that are folded inwardly and adhered against corresponding surfaces of the front 14 and back 16 of blank 10, respectively, as shown box 10 as fully-constructed in FIGS. 2–3. Front 14 and lateral sides 18 each have partial top flaps 24 that fold over inwardly and are adhered onto internal surfaces 26, 27 of the front and sides, respectively. Back 16 has a panel 28 that folds inwardly over onto an inner surface 30 thereof and a lower flap 32 that is folded inwardly and adhered to bottom 12, as shown in FIGS. 2–3. As shown in FIG. 2, the inwardly facing surface of panel displays product indicia of the type shown, to prospective or new purchasers. Moreover, the display presented by panel 28 is visible to purchasers from the viewpoint of the front of box 10.

Referring to FIGS. 4–6, box 10 is fully-constructed in the manner described above in relation to FIGS. 1–3. A flip-tag in the form of figurine, generally indicated at 34, has a base 36 adhered or otherwise secured to the front flap 24 presenting a display side 38 facing outwardly toward the purchaser when figurine is folded upwardly and outwardly from a stowed (FIG. 4) to a displayed (FIG. 5) position. The various stowed and displayed positions are further shown in phantom (stowed) in FIG. 6.

The flip-tag 34 and internal back display panel 28 may be employed as product indicia, either alone or separately in box 10.

Obviously, other substitutions, modifications and alterations of the embodiments presented herein are made apparent to those skilled in art, without departing from the scope of the present invention. Thus, the description contained in this Specification is intended by way of example rather than limitation vis-a-vis the appended Claims.

What is claimed is:

1. A shoe box comprising: a bottom, a front, a back and lateral sides, the box having an open top wherein the front and lateral sides have partial internal flaps folded over their top edges forming an internal border, the back side having an internal panel that is folded over, presenting a display with printed product information, and further comprising a flip tag having an indicia-bearing outer surface and a base secured to an internal surface of the front, the tag being reversibly foldable upwardly and outwardly from a stowed to a displayed position facing a prospective purchaser.

* * * * *